US006217039B1

(12) United States Patent
Iverson et al.

(10) Patent No.: US 6,217,039 B1
(45) Date of Patent: Apr. 17, 2001

(54) ADJUSTABLE SKATE

(75) Inventors: Robert A. Iverson, Eden Prairie, MN (US); Henry T. Chen, Taipei (TW)

(73) Assignee: Minson Enterprises Co., Ltd., Taipei (TW)

( * ) Notice: Subject to any disclaimer, the term of this patent is extended or adjusted under 35 U.S.C. 154(b) by 0 days.

(21) Appl. No.: 09/141,170

(22) Filed: Aug. 27, 1998

Related U.S. Application Data

(60) Provisional application No. 60/073,464, filed on Feb. 2, 1998.

(51) Int. Cl.[7] ..... A63C 17/26

(52) U.S. Cl. ..... 280/11.26; 280/11.27

(58) Field of Search ..... 280/7.1, 7.13, 280/11.19, 11.26, 11.27, 11.221, 11.222, 11.223, 11.224; 36/97, 115

(56) References Cited

U.S. PATENT DOCUMENTS

| | | | | |
|---|---|---|---|---|
| Re. 32,346 | | 2/1987 | Klamer et al. | 280/11.2 |
| 831,210 | | 9/1906 | Bosley | 36/8 |
| 2,009,684 | | 7/1935 | Affronte | 36/2.5 |
| 2,112,052 | | 3/1938 | Smith | 36/2.5 |
| 2,391,720 | | 12/1945 | Ludwig | 36/11.5 |
| 2,497,175 | | 2/1950 | Mantos | 36/2.5 |
| 2,523,449 | | 9/1950 | Rosenzweig | 36/2.5 |
| 2,603,889 | | 7/1952 | Lahnstein et al. | 36/2.5 |
| 2,734,284 | | 2/1956 | Seurbom | 36/2.5 |
| 2,745,196 | | 5/1956 | Schneider et al. | 36/2.5 |
| 2,746,117 | | 5/1956 | Maccarone | 36/46.5 |
| 3,027,658 | | 4/1962 | Rigsby | 36/2.5 |
| 3,045,367 | | 7/1962 | McKeon | 36/72 |
| 3,058,241 | | 10/1962 | Rigsby | 36/2.5 |
| 3,389,481 | | 6/1968 | England | 36/2.5 |
| 3,744,163 | | 7/1973 | Simister | 36/2.5 |
| 3,993,318 | * | 11/1976 | Rothmayer | 280/11.26 |
| 3,997,985 | * | 12/1976 | Shiina | 36/97 |
| 4,060,918 | | 12/1977 | Mandel | 36/97 |
| 4,083,128 | | 4/1978 | Rossman | 36/97 |
| 4,126,323 | | 11/1978 | Scherz | 280/11.12 |

(List continued on next page.)

FOREIGN PATENT DOCUMENTS

| | | | | |
|---|---|---|---|---|
| 714751 | | 8/1965 | (CA) . | |
| 1321066 | | 8/1993 | (CA) . | |
| 2584936 | * | 1/1987 | (FR) | 280/11.26 |
| 2658371 | * | 8/1991 | (FR) | 280/11.26 |
| 2672812 | * | 8/1992 | (FR) | 280/11.26 |

*Primary Examiner*—Frank Vanaman
(74) *Attorney, Agent, or Firm*—Kinney & Lange, P.A.

(57) ABSTRACT

A skate includes a boot that includes a heel portion and a toe box portion. The heel portion is disposed on a wheel holder frame that holds a plurality of ground-engaging wheels. The toe box portion is disposed slidably on the wheel holder frame and is slidable in relation to the heel portion. The heel portion includes left and right forwardly extending vamp sections that extend into the toe box portion. The toe box portion includes an inside surface that extends from a forward tip transversely and rearwardly toward the heel portion in a curved fashion. The vamp sections engage the inside surface of the toe box portion such that the vamp sections are flexed inwardly or outwardly as the toe box is slid on the wheel holder frame thereby varying the width and the length of the boot.

14 Claims, 5 Drawing Sheets

U.S. PATENT DOCUMENTS

| | | | | |
|---|---|---|---|---|
| 4,554,749 | | 11/1985 | Ostrander | 36/102 |
| 4,839,972 | | 6/1989 | Pack et al. | 36/117 |
| 4,944,099 | | 7/1990 | Davis | 36/97 |
| 4,998,358 | | 3/1991 | Girardelli | 36/117 |
| 5,388,846 | * | 2/1995 | Gierveld | 280/11.22 |
| 5,400,484 | * | 3/1995 | Gay | 280/11.19 |
| 5,408,763 | | 4/1995 | Sartor et al. | 36/115 |
| 5,452,907 | | 9/1995 | Meibock et al. | 280/11.22 |
| 5,459,949 | | 10/1995 | MacPhail | 36/117 |
| 5,475,936 | | 12/1995 | Cavasin | 36/115 |
| 5,484,149 | | 1/1996 | Lee | 280/11.26 |
| 5,498,009 | * | 3/1996 | Young | 280/11.26 |
| 5,645,288 | | 7/1997 | Lu | 280/11.26 |
| 5,678,833 | | 10/1997 | Olson et al. | 280/11.22 |
| 5,682,687 | * | 11/1997 | Arai | 36/97 |
| 5,741,018 | | 4/1998 | Huang | 280/11.3 |
| 5,836,592 | * | 11/1998 | Chang | 280/11.26 |
| 5,842,293 | * | 12/1998 | Young | 280/11.22 |
| 5,934,693 | * | 8/1999 | Nicoletti | 280/11.22 |
| 6,050,574 | * | 4/2000 | Olson et al. | 280/11.26 |

* cited by examiner 21
20
10
24
22
12
26
7
42
4
4
31
14
82
18
92
18
16
16
16
16
7

21
20
10
24
22
12
42
26
31
82
18
92
18
16
16

ADJUSTABLE SKATE

This application claims benefit of Provisional application 60/073,464, filed Feb. 2, 1998.

BACKGROUND OF THE INVENTION

The present invention relates to in-line skates, and in particular to in-line skates wherein the boot size is adjustable to accommodate different foot sizes.

In-line skating has become a popular recreational pastime, especially for children. However, children have growing feet, and to enjoy in-line skating the skates should properly fit the child's feet. Of course with growing feet, a new pair of skates must be purchased as the child's feet grow, sometimes on an annual basis.

The following patent describes in-line skates wherein the boot size is adjustable or the length of the in-line skate is adjustable to accommodate a different boot size:

| Inventor | Patent No. |
|---|---|
| Sartor et al. | 5,408,763 |
| Meibock et al. | 5,452,907 |
| MacPhail | 5,459,949 |
| Lee | 5,484,149 |
| Lu | 5,645,288 |
| Olson et al. | 5,678,833 |
| Huang | 5,741,018 |
| Klamer et al. | Re. 32,346 |

BRIEF SUMMARY OF THE INVENTION

The present invention includes a boot that includes a heel portion and a toe box portion. The heel portion is disposed on a wheel holder frame. The toe box portion is disposed slidably on the wheel holder frame and is slidable in relation to the heel portion. The heel portion includes left and right forwardly extending vamp sections that extend into the toe box portion. The toe box portion includes an inside surface that extends from a forward tip transversely and rearwardly toward the heel portion in a curved fashion. The vamp sections engage the inside surface of the toe box portion such that the vamp sections are flexed inwardly or outwardly as the toe box is slid on the wheel holder frame thereby varying the width and the length of the boot.

DETAILED DESCRIPTION

Figure 1:
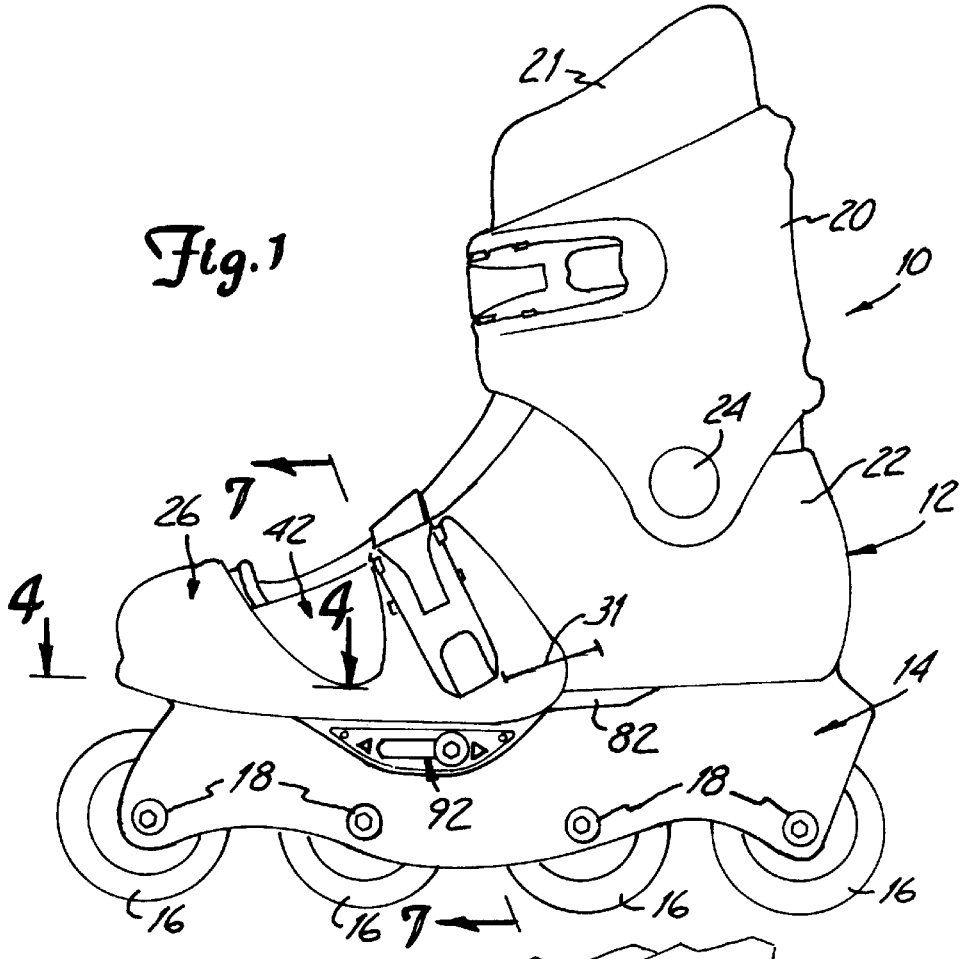
FIG. 1 is an elevational view of the present invention in a maximum boot size.
Figure 2:
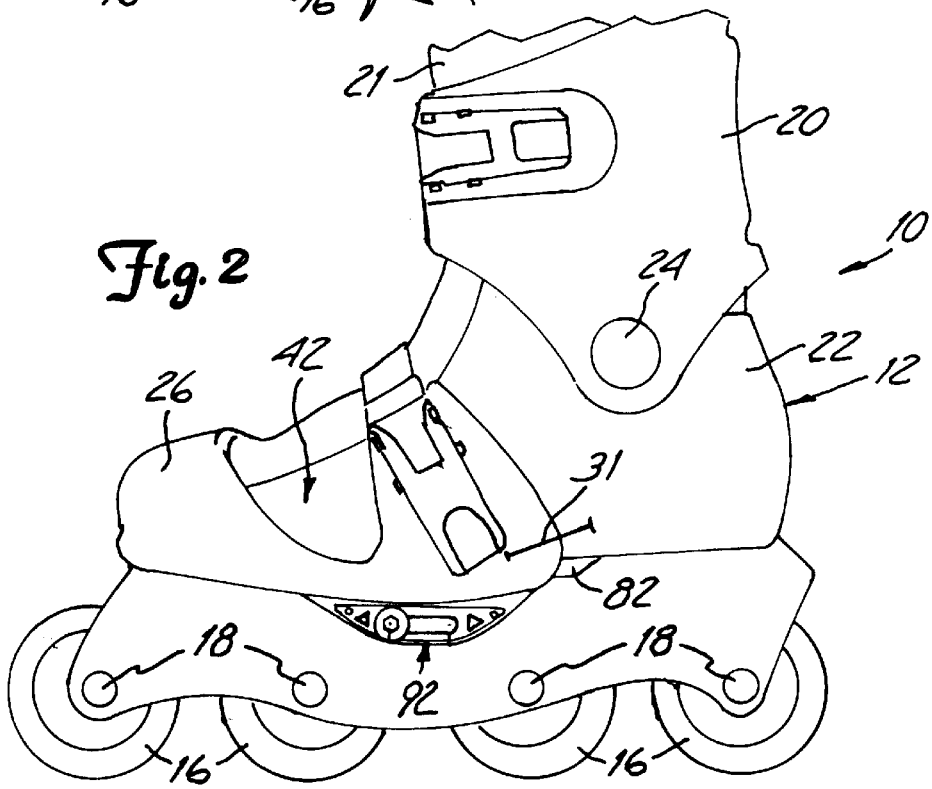
FIG. 2 is an elevational view of the present invention in a minimum boot size.

The skate of the present invention is generally illustrated at 10 in FIGS. 1 and 2. The skate 10 includes a boot 12 whose size may be modified in both length and width. The boot 12 includes a toe box 26 and a heel portion 22 disposed on a wheel holder frame 14. The boot 12 further includes a cuff portion 20 pivotally mounted to the heel portion 22 in a conventional manner by a pair of pivots 24, each pivot 24 being located on opposing sides of the cuff portion. A conventional buckle 23 is secured to the cuff 20 so that the cuff 20 may be securely fastened to the leg of a wearer.

The toe box 26 is slidably attached to the heel portion 22 and the wheel holder frame 14. The wheel holder frame 14 retains a plurality of freewheeling roller skate wheels 16. The wheels 16 are rotatably secured to the wheel frame holder 14 by suitable fasteners 18 that are well known in the art.

A suitable liner 21 has an elastic section proximate the toe box 26 so that the liner can accommodate different foot sizes. Such liners are known in the art.

The skate of the present invention being modifiable in both length and width is advantageous especially for use by youth whose foot size may change significantly in a short period of time. The length and width of the skate of the present invention is modified by moving the toe box 26 in relation to the heel portion 22 of the boot 12.

Figure 3:
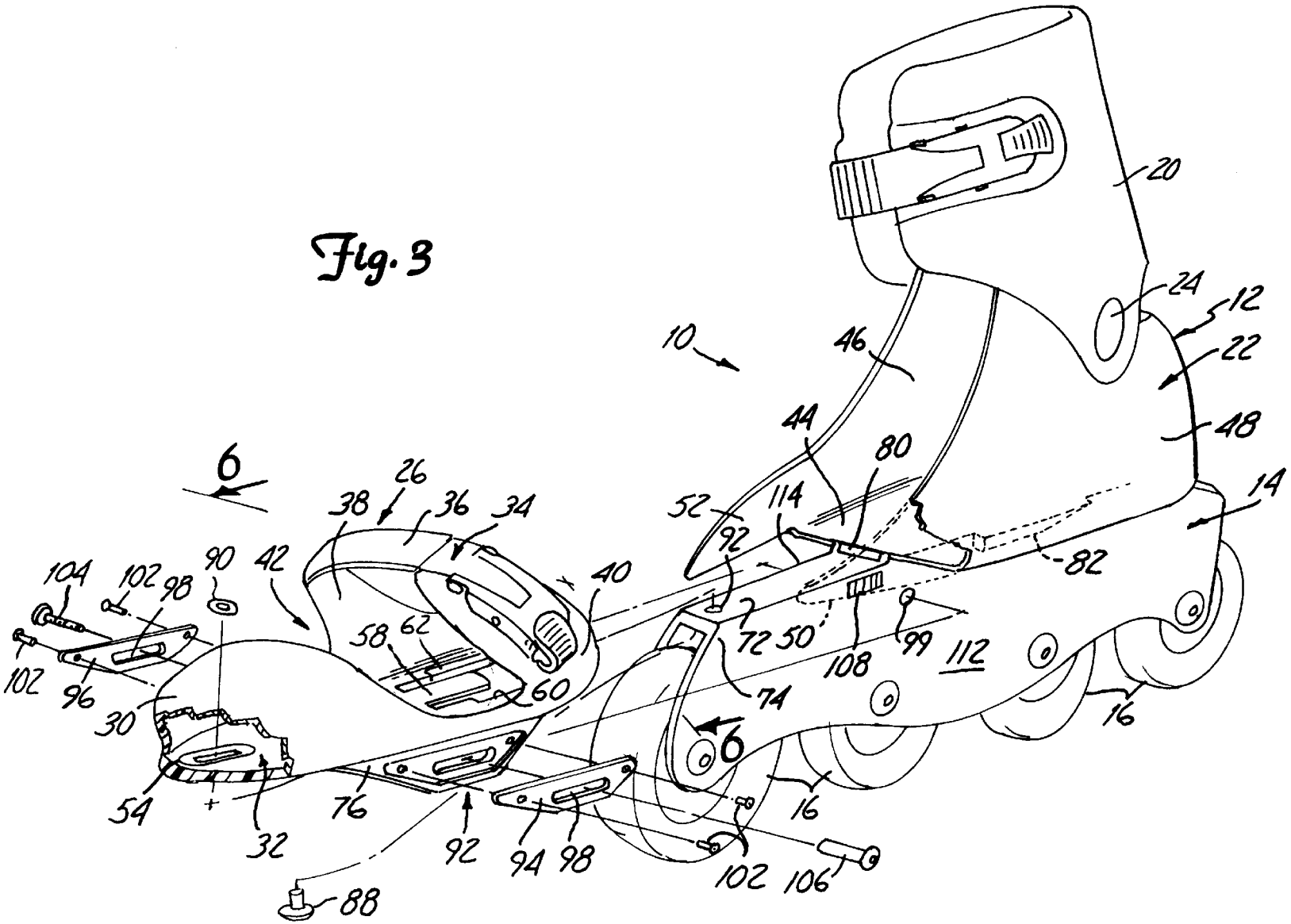
FIG. 3 is an exploded perspective view of the present invention.

The toe box 26 includes a forward toe cap portion 30 integrally formed with a toe sole portion 32 as illustrated in FIG. 3. The toe box 26 also includes a forward closure strap portion 34 that extends upwardly from the sole portion 32. A conventional buckle 36 is secured to the closure strap to secure the strap portion 34 to the wearer's foot. The closure strap portion 34 includes left and right strap members 38 and 40, each extending upwardly from the sole portion 32. The buckle 36 is attached to the strap members 38 and 40. The strap members 38 and 40 are positioned slightly forward of the instep 31 of the boot 12 and are spaced rearwardly of the toe cap 30 as best illustrated in FIGS. 1 and 2. The strap members are separated from the toe cap 30 by toe opening 42.

Figure 4:
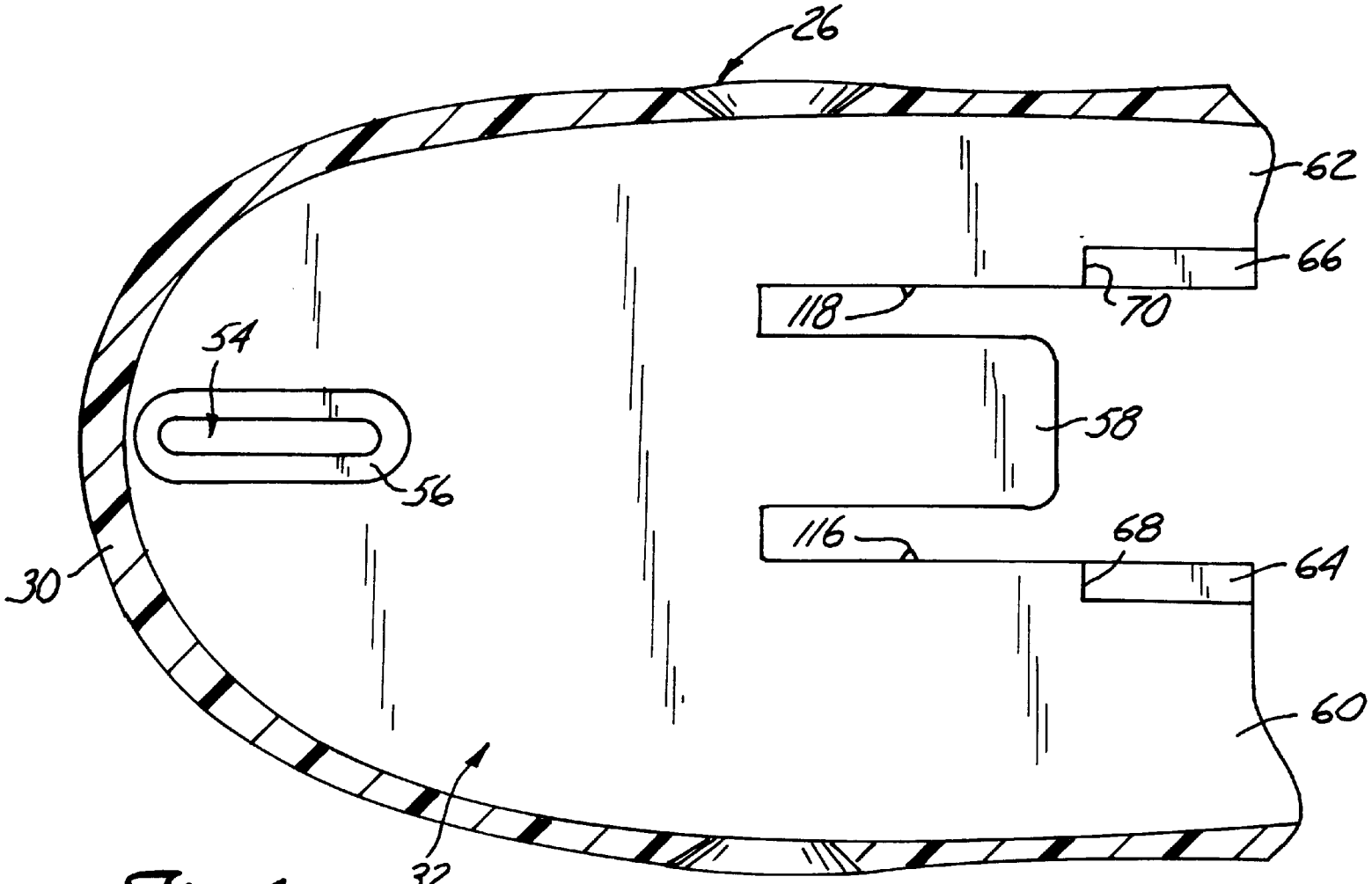
FIG. 4 is a sectional view of the toe box illustrating the toe box sole.

The toe sole portion 32 includes a toe slot 54 positioned under the toe cap 30 along a longitudinal axis of the boot 12, as illustrated in FIGS. 3 and 4. The slot 54 includes a recessed perimeter edge section 56 that is recessed below the surface of the toe sole portion 32. The toe sole portion 32 also includes a tongue member 58 and left and right shank members 60 and 62 that extend rearwardly toward the heel portion 22, as best illustrated in FIG. 4. The tongue member 58 is disposed between the left and right shank members 60 and 62. Left and right inwardly facing shoulder guides 64 and 66 are formed on oppositely facing edges of the left and right shank members 60 and 62. The shoulder guides 64 and 66 each end forwardly at a stop 68 and 70, respectively.

The heel portion 22 and the wheel frame holder 14 are preferably integrally formed. However, the heel portion 22 may be riveted to the wheel holder frame 14 as is well known in the art. The heel portion 22 includes a heel sole portion 44 and left and right quarters 48. The heel sole portion 44 extends forwardly approximately to the instep of the foot. Left and right vamp sections 50 and 52 extend forward past the heel sole 44 and into the toe cap 30 of the toe box 26. The toe box 26 includes inside surface 130 that extends from a forward tip 131 transversely and rearwardly toward the heel portion 22 in a curved fashion. The vamp sections 50 and 52 are capable of being flexed inwardly to adjust the width of the boot 12 of the present invention from the instep up to the toe by engaging the surface 130 as is discussed subsequently. It will be appreciated that the toe sole portion 32 and the heel sole portion 44 cooperate to form a single sole of the boot 12.

Figure 5:
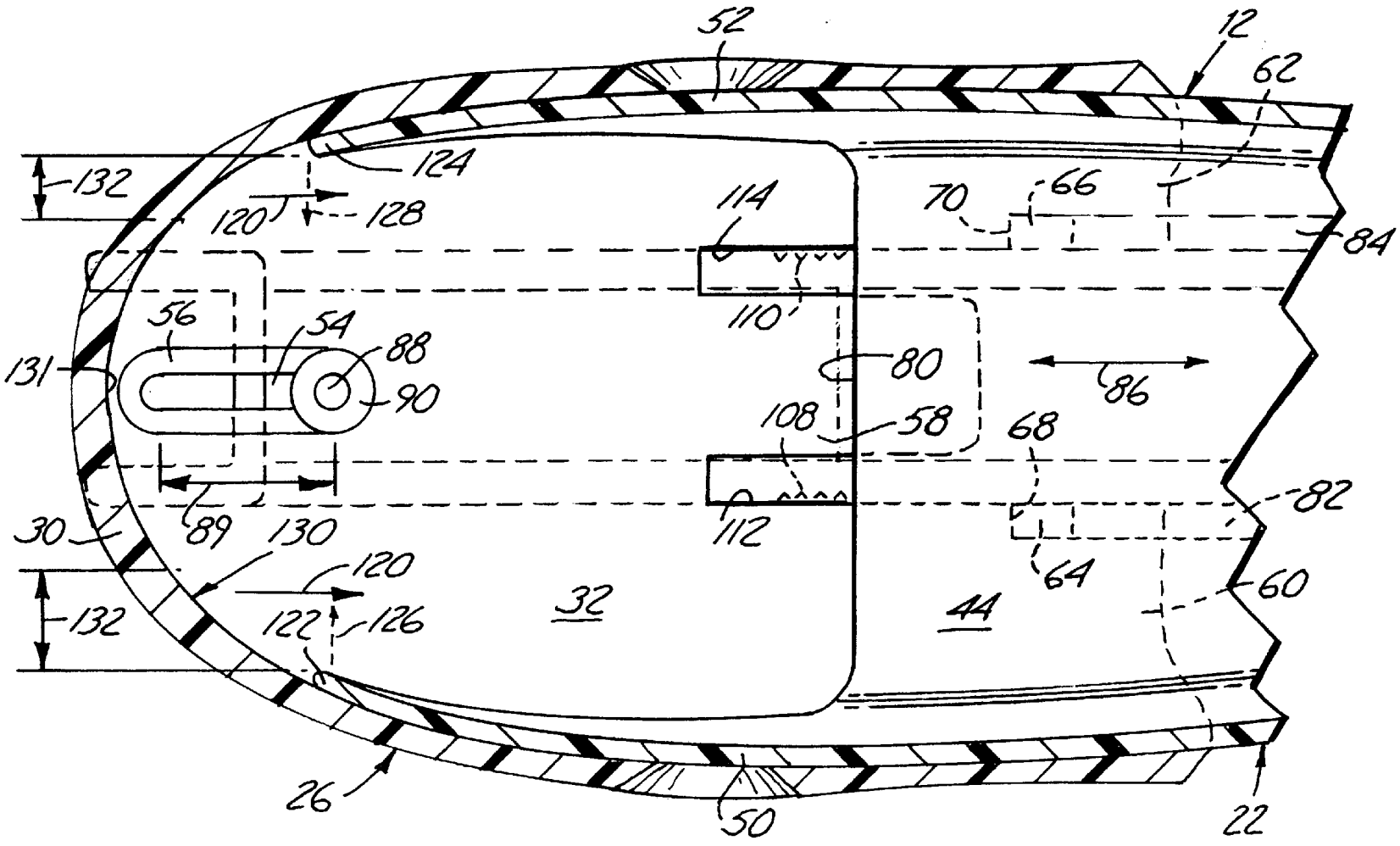
FIG. 5 is a sectional view taken along the line 5—5 in FIG. 1.
Figure 7:
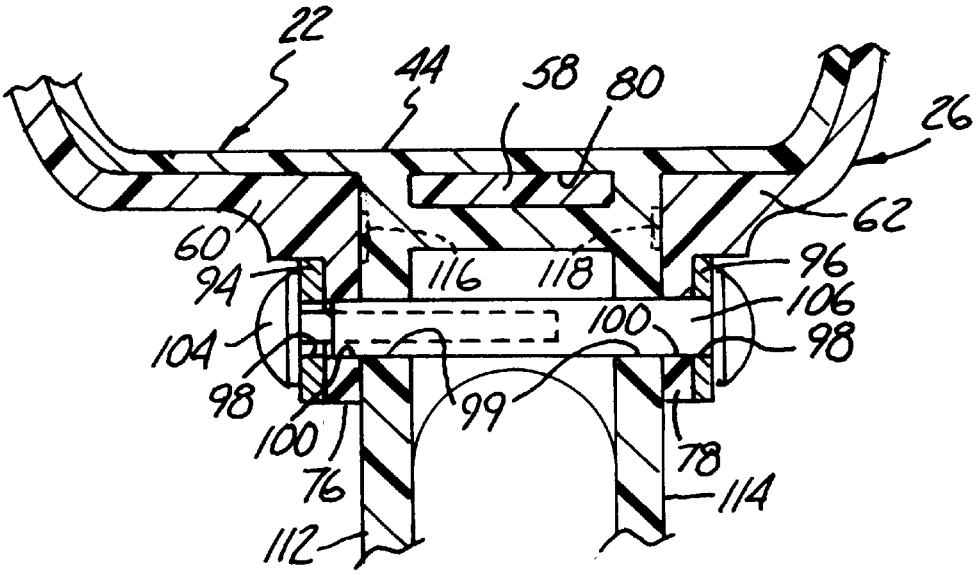
FIG. 7 is a sectional view taken along the line 7—7 in FIG. 1.
Figure 6:
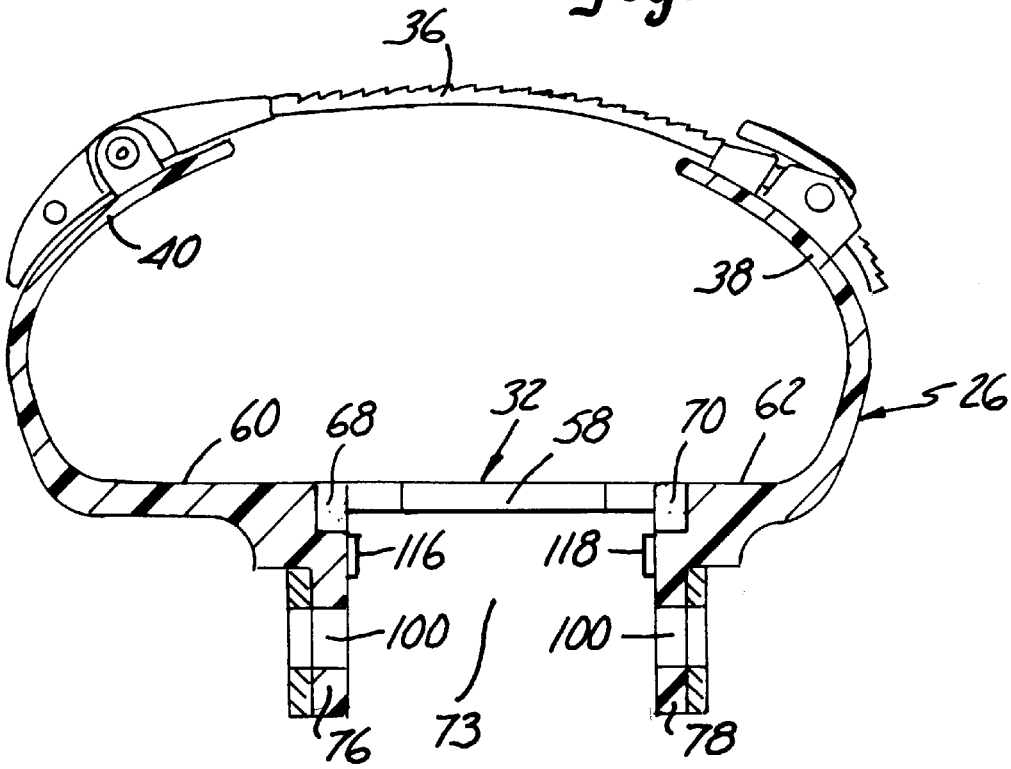
FIG. 6 is a sectional view taken along the line 6—6 in FIG. 3.

The tongue member 58 overlies a top forward surface 72 of the wheel holder frame 14. The toe box 26 includes a wheel holder frame channel 73 for accepting a forward section 74 of the wheel holder frame 14, as best illustrated in FIG. 6. The channel 73 is defined by a lower surface of the toe sole portion 32 and downwardly extending left and right channel sidewalls 76 and 78. The tongue member 58 extends into a shank slot 80 positioned at a forward end of the heel sole portion 44 between the heel sole portion and the top surface 72 of the wheel holder frame 14, as best illustrated in FIGS. 3 and 5. The left and right shank sections 60 and 62 extend along outer surfaces of the heel portion 22 rearwardly and below the heel sole portion 44, as best illustrated in FIGS. 1, 2 and 7.

Guide shoulders 82 and 84 are positioned directly below the heel sole portion 44 and along sidewalls 112 and 114 of the wheel holder frame 14. Guide shoulders 82 and 88 extend into shoulder guides 64 and 66, respectively, and cooperate with the tongue member 58 that is engaging the slot 80 to guide movement of the toe box 26 in a direction of arrows 86.

Further securing the toe box to a forward end of the wheel holder frame 14 is rivet 88 and rivet washer 90. The wheel holder frame includes an aperture 92 at a forward end extending through surface 72. The aperture 92 is aligned with the slot 54 of the toe box 26. The rivet 88 extends through the aperture 92 and through the slot 54 and through the rivet washer 90. The rivet washer 90 is disposed in the recessed perimeter edge section 56. The slot 54 moves along the rivet 88 as indicated by arrows 89 when the toe box 26 is moved in the direction of arrows 86 to extend or shorten the length of the boot 12 as illustrated in FIG. 5.

The toe box 26 is secured in a selected position by a locking mechanism 92. The toe box includes left and right downwardly extending channel sidewalls 76 and 78 for slidably engaging wheel holder frame sidewalls 112 and 114 as best illustrated in FIG. 7. The locking mechanism 92 includes left and right metal wear plates 94 and 96. Each metal wear plate has a slot 98 alignable with slots 100 in left and right channel sidewalls 76 and 78. The wear plates 94 and 98 are secured to left and right channel sidewalls 76 and 78, respectively, by screws 102. The wheel holder frame 14 includes apertures 99 disposed in wheel holder frame sidewalls 112 and 114. A locking screw 104 extends through the slots 98 and 100 and the apertures 99 and engages a locking nut 106 extending through slots 98 and 100 and apertures 99 from an opposite direction.

The locking mechanism 92 further includes a plurality of indentations 108 and 110 disposed within oppositely facing surfaces of the sidewalls 112 and 114 of the wheel holder frame 14, as best illustrated in FIGS. 3 and 5. Left and right detents 116 and 118 extending inwardly from surfaces of the left and right channel sidewalls 76 and 78 into the channel 73 to cooperatively engage one of the plurality of indentations 108 and 110, all respectively, to position the toe box 26 in one of a series of selected positions. The location of the detents and the indentations may be reversed so that the detents are located on sidewalls 112 and 114 and the indentations are located on left and right channel sidewalls 76 and 78. The toe box is secured in the selected position by tightening the screw 104 and the nut 106 which moves the left and right channel sidewalls 76 and 78 against surfaces 112 and 114 of the wheel bolder frame 14 thereby ensuring that detents 116 and 118 stay within the selected indentations 108 and 110, all respectively.

In FIG. 1, the boot 12 is illustrated in a maximum boot size since the toe box 26 is positioned as forwardly of the heel portion as possible. In FIG. 2, the boot 12 is illustrated in a minimum boot size since the toe box 26 is positioned as rearwardly as possible (toward the heel portion). To decrease the boot size or to make the boot smaller, the toe box 26 is moved rearwardly towards the heel portion as indicated by arrows 120, leading edges 122 and 124 of the vamp sections 50 and 52 move inwardly as indicated by arrows 126 and 128. The edges 122 and 124 are forced by the curved inner surface 130 of the toe box 26 toward the center of the boot, as illustrated in FIG. 5. As the leading edges 122 and 124 of vamp sections 50 and 52 are adjusted inwardly, it will be appreciated that the entire vamp sections 50 and 52 also will be moved inwardly, thereby adjusting the width of a forward section of the boot 12. Stops 68 and 70 limit rearward travel of the toe box 26 by engagement of guide shoulders 82 and 84 and the rivet 88 engaging a forward end of slot 54. Of course, as the toe box is moved rearwardly, the length of the boot is also adjusted simultaneously with adjustment of the width.

In reverse, to increase the length of the boot, the toe box is moved forwardly. As the toe box is moved forwardly, the leading edges 122 and 124 of the vamp sections 50 and 52 flex outwardly thereby increasing the width of the forward section of the boot 12 while the length of the boot is being increased. As illustrated in FIG. 5, the rivet 88 limits the toe box's forward travel by engaging a rearward end of slot 54.

Although the present invention has been described with reference to preferred embodiments, workers skilled in the art will recognize that changes may be made in form and detail without departing from the spirit and scope of the invention.

What is claimed is:

1. A skate comprising:

a wheel holder frame for holding a plurality of ground engaging wheels;

a boot comprising:

a heel portion disposed on the wheel holder frame;

a toe box portion slidable on the wheel holder frame;

wherein the heel portion includes left and right forwardly extending vamp sections extending into the toe box portion;

wherein the toe box portion includes first and second downwardly extending channel walls and an inside surface extending from a forward tip and extending transversely and rearwardly toward the heel portion in a curved fashion with the vamp sections engaging left and right inside surfaces of the toe box portion such that the vamp sections are flexed inwardly or outwardly as the toe box portion is slid rearwardly or forwardly to adjust the width and length of the boot, and wherein the wheel holder frame includes a forward section extending between the first and second channel walls, and a locking mechanism for securing the toe box in a selected position, the wheel holder frame further including first and second detents disposed on either the forward section of the wheel frame holder or the first and second channel walls, and a plurality of indentations disposed in either the forward section of the wheel frame holder or the first and second channel walls for engaging the first and second detents, respectively, and a frame aperture extending through the wheel holder frame and the side channel walls including slots alignable with the frame aperture, and further including a securing pin member extending through the slots and the frame aperture, the securing pin member further including a securing mechanism for engaging the side channel walls against the wheel holder frame to secure the toe box portion in a selected position in cooperation with the locking mechanism.

2. The skate of claim 1 wherein the toe box includes a slot disposed longitudinally along a longitudinal axis of the boot and wherein the wheel holder frame includes an aperture, and further including a pin extending through the slot and the aperture such that the toe box may be slid rearwardly or forwardly guided by the slot engaging the pin.

3. The skate of claim 2 wherein the pin is a rivet securing the toe box at a forward end to the wheel frame holder.

4. The skate of claim 1 wherein the toe box portion includes a tongue member extending towards the heel portion and the wheel holder frame includes a slot for receiving the tongue member.

5. The skate of claim 1 wherein the toe box portion includes left and right shank sections extending rearwardly toward the heel portion and engaging outer surfaces of the wheel holder frame.

6. The skate of claim 5 wherein the left and right shank sections include shoulder guides and further including left and right shoulders disposed on the wheel holder frame, the left and right shoulders extending into the left and right shoulder guides.

7. The skate of claim 6 and further including a stop member disposed at a forward end of each shoulder guide to limit rearward movement of the toe box portion.

8. A skate comprising:

a wheel holder frame;

a boot disposed on the wheel holder frame and having a heel portion and a slidably attached toe box portion having first and second downwardly extending channel walls, the boot having left and right flexible vamp sections engagable by the toe box portion wherein when the toe box portion is slid either rearwardly or forwardly to shorten or lengthen the boot, the vamp sections are flexed inwardly or outwardly to vary the boot width; and wherein the wheel holder frame includes a forward section extending between the first and second channel walls and a locking mechanism for securing the toe box in a selected position, the locking mechanism including first and second detents disposed on either the forward section of wheel frame holder or the first and second channel walls, and a plurality of indentations disposed in either the forward section of the wheel frame holder or the first and second channel walls for engaging the first and second detents, respectively and a frame aperture extending through the wheel holder and the channel walls including slots alignable with the frame aperture, and further including a securing pin member extending through the slots and the frame aperture, the securing pin member further including a securing mechanism for engaging the channel walls against the wheel holder frame to secure the toe box portion in a selected position in cooperation with the locking mechanism.

9. The skate of claim 8 wherein the toe box portion includes a slot disposed along a longitudinal axis of the boot and wherein the wheel holder frame includes an aperture, and further including a pin extending through the slot and the aperture such that the toe box portion may be slid rearwardly or forwardly guided by the slot engaging the pin.

10. The skate of claim 9 wherein the pin is a rivet securing the toe box portion at a forward end to the wheel holder frame.

11. The skate of claim 8 wherein the toe box portion includes a tongue member extending towards the heel portion and the wheel holder frame includes a slot for receiving the tongue member.

12. The skate of claim 8 wherein the toe box portion includes left and right shank sections extending rearwardly toward the heel portion and engaging outer surfaces of the wheel holder frame.

13. The skate of claim 12 wherein the left and right shank sections include shoulder guides and further including left and right shoulders disposed on the wheel holder frame, the left and right shoulders extending into the left and right shoulder guides.

14. The skate of claim 13 and further including a stop member disposed at a forward end of each shoulder guide to limit rearward movement of the toe box portion.

* * * * *